US012259147B1

(12) United States Patent
Jaber et al.

(10) Patent No.: US 12,259,147 B1
(45) Date of Patent: Mar. 25, 2025

(54) SYSTEMS AND METHODS FOR INDOOR AIR TEMPERATURE CONTROL FOR HEAT PUMP SYSTEMS

(71) Applicant: Trane International Inc., Davidson, NC (US)

(72) Inventors: Youssef A. Jaber, Tyler, TX (US); Don A. Schuster, Lindale, TX (US); Nathan Smith, Tyler, TX (US); Jonathan Edward Thrift, Jacksonville, TX (US)

(73) Assignee: Trane International Inc., Davidson, NC (US)

( * ) Notice: Subject to any disclaimer, the term of this patent is extended or adjusted under 35 U.S.C. 154(b) by 684 days.

(21) Appl. No.: 16/509,261

(22) Filed: Jul. 11, 2019

(51) Int. Cl.

| | |
|---|---|
| ***F24F 11/30*** | (2018.01) |
| ***F25B 30/02*** | (2006.01) |
| ***F25B 49/02*** | (2006.01) |
| *F24F 110/10* | (2018.01) |

(52) U.S. Cl.
CPC ..... *F24F 11/30* (2018.01); *F25B 30/02* (2013.01); *F25B 49/022* (2013.01); *F24F 2110/10* (2018.01); *F25B 2700/21157* (2013.01)

(58) Field of Classification Search
CPC ..... F24F 11/30; F24F 2110/10; F25B 30/02; F25B 49/022; F25B 2700/21157
See application file for complete search history.

(56) References Cited

U.S. PATENT DOCUMENTS

| | | | | |
|---|---|---|---|---|
| 4,291,542 | A * | 9/1981 | Sminge | B01D 53/265 62/156 |
| 4,523,435 | A | 6/1985 | Lord | |
| 4,932,217 | A | 6/1990 | Meyer | |
| 5,062,276 | A | 11/1991 | Dudley | |
| 5,144,812 | A | 9/1992 | Mills, Jr. et al. | |
| 5,475,986 | A | 12/1995 | Bahel et al. | |
| 5,771,703 | A | 6/1998 | Rajendran | |

(Continued)

FOREIGN PATENT DOCUMENTS

| | | | |
|---|---|---|---|
| CN | 103423835 | A | 12/2013 |
| CN | 104006485 | A * | 8/2014 |

(Continued)

OTHER PUBLICATIONS

Iwamoto, Air Conditioner for Vehicle, Oct. 21, 2010, JP2010234836A, Whole Document (Year: 2010).

(Continued)

*Primary Examiner* — Larry L Furdge
(74) *Attorney, Agent, or Firm* — Womble Bond Dickson (US) LLP

(57) ABSTRACT

Methods and related systems for controlling an indoor air temperature for a heat pump system are disclosed. The method includes (a) determining an outdoor coil temperature of an outdoor heat exchanger and a speed of a compressor of a heat pump system, (b) determining a target indoor coil temperature of the indoor coil based on the outdoor coil temperature and the speed of the compressor, and (c) adjusting a speed of air flowing across the indoor coil based on a difference between a current indoor coil temperature and the target indoor coil temperature to reduce the difference between the current indoor coil temperature and the target indoor coil temperature.

23 Claims, 2 Drawing Sheets

(56) References Cited

U.S. PATENT DOCUMENTS

| | | | |
|---|---|---|---|
| 5,992,161 | A | 11/1999 | O'Halloran et al. |
| 6,109,533 | A | 8/2000 | Ao et al. |
| 6,269,650 | B1 | 8/2001 | Shaw |
| 7,975,495 | B2 | 7/2011 | Voorhis et al. |
| 8,156,750 | B2 | 4/2012 | Butorac et al. |
| 9,696,067 | B2 | 7/2017 | Rite et al. |
| 10,247,459 | B2 | 4/2019 | Nishiyama et al. |
| 2002/0124585 | A1 | 9/2002 | Bash et al. |
| 2004/0107715 | A1 | 6/2004 | Lee et al. |
| 2004/0244393 | A1 | 12/2004 | Lucas et al. |
| 2008/0135635 | A1 | 6/2008 | Deng et al. |
| 2008/0184715 | A1 | 8/2008 | Chen et al. |
| 2009/0151378 | A1 | 6/2009 | Kawakatsu et al. |
| 2009/0192650 | A1 | 7/2009 | Tonner |
| 2009/0299529 | A1 | 12/2009 | Hill et al. |
| 2010/0180630 | A1 | 7/2010 | Ogawa |
| 2010/0223941 | A1 | 9/2010 | Shah et al. |
| 2010/0300125 | A1 | 12/2010 | Cikanek et al. |
| 2011/0041539 | A1 | 2/2011 | Nylykke |
| 2012/0067070 | A1 | 3/2012 | Albertson |
| 2012/0090337 | A1 | 4/2012 | Chen et al. |
| 2012/0152515 | A1 | 6/2012 | Okabe et al. |
| 2012/0198867 | A1 | 8/2012 | Ng et al. |
| 2013/0174591 | A1 | 7/2013 | Das et al. |
| 2013/0340452 | A1 | 12/2013 | Kleman et al. |
| 2014/0165612 | A1 | 6/2014 | Qu et al. |
| 2014/0182832 | A1 | 7/2014 | Styles et al. |
| 2014/0345307 | A1 | 11/2014 | Bagley et al. |
| 2015/0059373 | A1 | 3/2015 | Maiello et al. |
| 2015/0068226 | A1* | 3/2015 | Rite ..... F24D 5/04 62/79 |
| 2016/0159198 | A1 | 6/2016 | Tang et al. |
| 2016/0200176 | A1 | 7/2016 | Stanke et al. |
| 2016/0236538 | A1 | 8/2016 | Suzuki et al. |
| 2016/0290671 | A1* | 10/2016 | Schuster ..... F04C 18/0215 |
| 2017/0108231 | A1 | 4/2017 | Hasegawa et al. |
| 2017/0153037 | A1 | 6/2017 | Goel et al. |
| 2017/0211833 | A1 | 7/2017 | Tran et al. |
| 2017/0343260 | A1 | 11/2017 | Austin et al. |
| 2017/0370608 | A1 | 12/2017 | Okochi |
| 2018/0058740 | A1 | 3/2018 | Nishiyama et al. |
| 2018/0373278 | A1 | 12/2018 | Walser |
| 2021/0084835 | A1 | 3/2021 | Bowling et al. |

FOREIGN PATENT DOCUMENTS

| | | | | |
|---|---|---|---|---|
| CN | 104990236 | A | | 10/2015 |
| CN | 105650812 | A | | 6/2016 |
| CN | 109855185 | A | | 6/2019 |
| EP | 2488796 | B1 | | 12/2018 |
| JP | H0350437 | A | * | 3/1991 |
| JP | 2001-272084 | A | | 10/2001 |
| JP | 2001-317795 | A | | 11/2001 |
| JP | 2007010254 | A | * | 1/2007 |
| JP | 2010-234836 | A | | 10/2010 |
| WO | 2009/088517 | A1 | | 7/2009 |

OTHER PUBLICATIONS

Lin, Xiaojie, et al.; "Review of Temperature and Humidity Control Technology for Heat Pump and Air Conditioning Systems"; 16th International Refrigeration and Air Conditioning Conference at Purdue; Jul. 11-14, 2016; 10 pages.

Qi, Qi, et al.; "Multivariable Control of Indoor Air Temperature and Humidity in a Direct Expansion (DX) Air Conditioning (A/C) System"; Building and Environment 44; 2009; 9 pages.

Tanaka et al., Air Conditioner, Oct. 5, 2001, JP2001272084A, Whole Document (Year: 2001).

Yang et al., Air Conditioner and Dehumidification Control Method Thereof, Jun. 17, 2019, CN109855185A, Whole Document (Year: 2019).

* cited by examiner

SYSTEMS AND METHODS FOR INDOOR AIR TEMPERATURE CONTROL FOR HEAT PUMP SYSTEMS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

When heating systems operate to warm the air within an indoor space (e.g., such as a residential home, office space, storage unit, etc.), the temperature of the air delivered to the indoor space by the heating system may have a significant impact on the comfort of the occupants. For instance, in some circumstances, if a temperature of the air delivered from the heating system to the indoor space is not sufficiently above the current indoor temperature, occupants may feel a cool or cold draft. Such a phenomenon may be referred to as "cold blow."

BRIEF SUMMARY

Some embodiments disclosed herein are directed to a method of controlling indoor air temperature of a heat pump system. In an embodiment, the method includes (a) determining an outdoor coil temperature of an outdoor heat exchanger and a speed of a compressor of a heat pump system. In addition, the method includes (b) determining a target indoor coil temperature of the indoor coil based on the outdoor coil temperature and the speed of the compressor. Further, the method includes (c) adjusting a speed of air flowing across the indoor coil based on a difference between a current indoor coil temperature and the target indoor coil temperature to reduce the difference between the current indoor coil temperature and the target indoor coil temperature.

Other embodiments disclosed herein are directed to a heat pump system. In an embodiment, the heat pump system includes an indoor heat exchanger comprising an indoor coil to flow refrigerant therethrough, an outdoor heat exchanger comprising an outdoor coil to flow refrigerant therethrough, and a first sensor configured to detect a value indicative of a temperature of the outdoor coil. In addition, the heat pump system comprises an indoor fan configured to flow air over the indoor coil, and a compressor configured to compress the refrigerant that is to be flowed through the indoor coil and the outdoor coil. Further, the heat pump system includes a controller to be coupled to the first sensor, the indoor fan, and the compressor. The controller is configured to: (a) determine a temperature of the outdoor coil via the first sensor and a speed of the compressor; (b) determine a target indoor coil temperature based on the temperature of outdoor coil and the speed of the compressor; and (c) adjust a speed of air flowing across the indoor coil based on a difference between the indoor coil temperature and the target indoor coil temperature.

Still other embodiments disclosed herein are directed to non-transitory machine readable medium including instructions that are to be executed by a processor. In an embodiment, the machine readable medium includes instructions that, when executed by the processor, cause the processor to: (a) determine an outdoor coil temperature of an outdoor heat exchanger and a speed of a compressor of a heat pump system; (b) determine a target indoor coil temperature of the indoor coil of an indoor heat exchanger of the heat pump system based on the outdoor coil temperature and the speed of the compressor; and (c) adjust a speed of air flowing across the indoor coil based on a difference between a current indoor coil temperature and the target indoor coil temperature.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
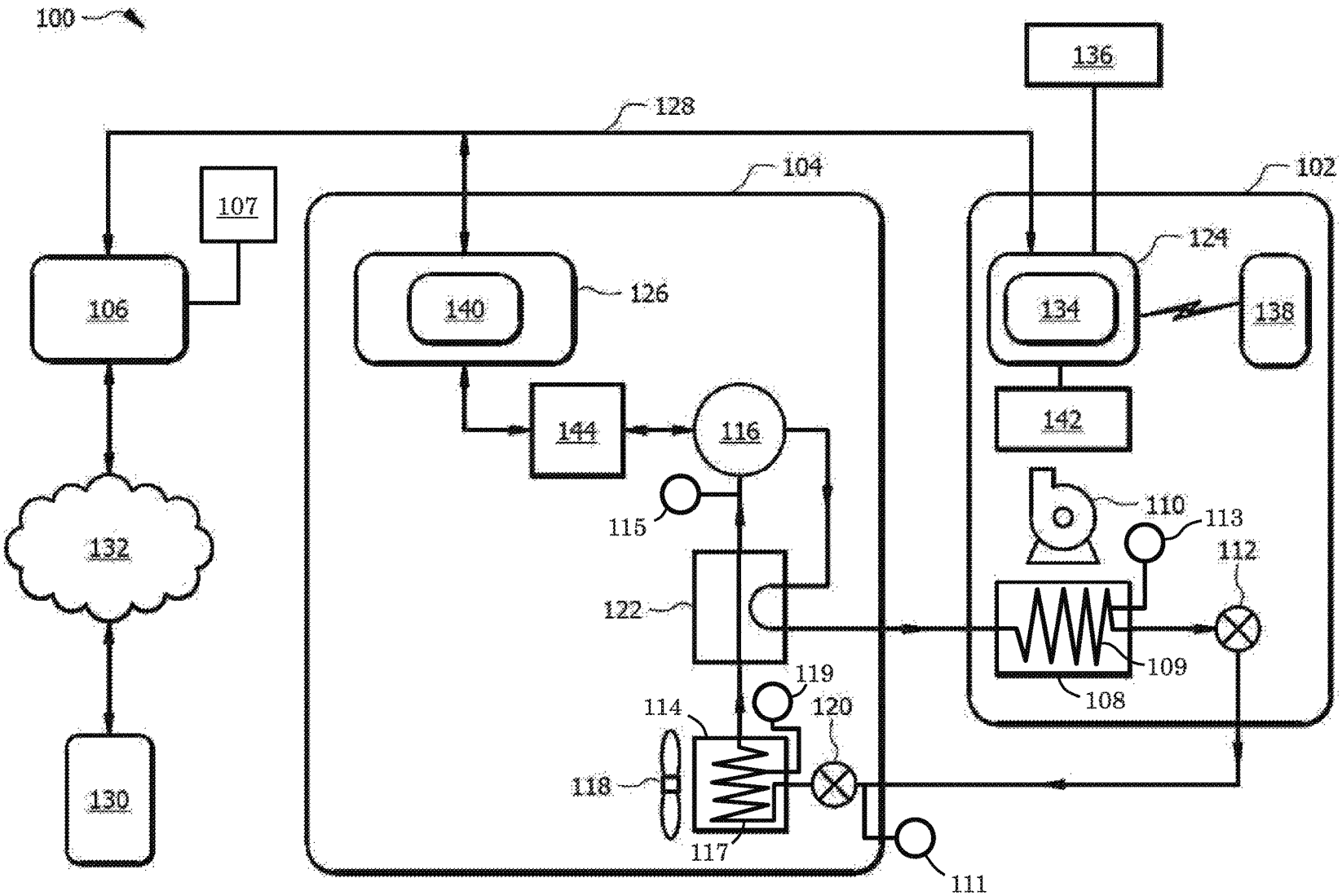
FIG. 1 is a diagram of a heat pump system configured for operating in a heating mode according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis.

For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

As previously described, if a temperature of the air delivered from a heating system for an indoor space is not sufficiently above the current indoor temperature, occupants within the indoor space may feel a cool or cold draft known as cold blow. As a result, one may wish to ensure that air delivered from a heating system is sufficiently above the current indoor temperature so as to avoid occupant discomfort. In addition, when the indoor heating system is a heat pump system, one may also wish to avoid overly taxing the compressor of such a system (e.g., such as when the ambient outdoor temperatures are particularly low). Accordingly, embodiments disclosed herein includes systems and methods for controlling an indoor air temperature delivered from a heat pump system so as to avoid cold blow and so as to avoid operating a compressor of the heat pump outside of a desired window or envelope.

Referring now to FIG. 1, a schematic diagram of a climate control system 100 according to some embodiments is shown. In this embodiment, climate control system 100 is a heat pump system, and thus, system 100 may be referred to herein as heat pump system 100. Most generally, heat pump system 100 may be selectively operated to implement one or more substantially closed thermodynamic refrigeration cycles to provide a heating functionality (hereinafter "heating mode") and/or a cooling functionality (hereinafter "cooling mode"). The heat pump system 100 generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. Specifically, indoor heat exchanger 108 may include a coil 109 for channeling the refrigerant therethrough that segregates the refrigerant from any air flowing through indoor heat exchanger 108 during operations. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 (specifically across or over the coil 109) to promote heat transfer between the airflow and a refrigerant flowing through the coil 109 of the indoor heat exchanger 108. The indoor fan 110 may also be configured to deliver temperature-conditioned air from the indoor unit 102 to one or more areas and/or zones of an indoor space. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. Specifically, outdoor heat exchanger 114 may include a coil 117 for channeling the refrigerant therethrough that segregates the refrigerant from any air flowing through outdoor heat exchanger 114 during operations. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In some embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 (specifically across or over the coil 117) to promote heat transfer between the airflow and a refrigerant flowing through the coil 117 of outdoor heat exchanger 114. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the heat pump system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the heat pump system 100. In some embodiments, the system controller 106 may be configured to control operation of the indoor unit 102 and/or the outdoor unit 104. In some embodiments, the system controller 106 may be configured to monitor and/or communicate, directly or indirectly, with a plurality of sensors associated with components of the indoor unit 102, the outdoor unit 104, etc. The sensors may measure or detect a variety of parameters, such as, for example, pressure, temperature, and flow rate of the refrigerant as well as pressure and temperature of other components or fluids of or associated with heat pump system 100. In some embodiments, the heat pump system 100 may include a sensor (or plurality of sensors) for sensing or detecting the ambient outdoor temperature. Additionally, in some embodiments, the system controller 106 may comprise a temperature sensor and/or may further be configured to control heating and/or cooling of zones associated with the heat pump system 100 (e.g., within the indoor space). In some embodiments, the system controller 106 may be configured as a thermostat, having a temperature sensor and user interface, for controlling the supply of conditioned air to zones associated within the heat pump system 100.

In some embodiments, heat pump system 100 may include a pressure sensor 111 configured to sense or detect a pressure of the refrigerant upstream of outdoor metering device 120 and downstream of indoor heat exchanger 108 (that is when heat pump system 100 is operated in the heating mode as shown in FIG. 1 and described in more detail below). In addition, heat pump system 100 may include a pressure sensor 115 configured to sense or detect a pressure of the refrigerant upstream of compressor 116 and downstream of outdoor heat exchanger 114 (again when heat pump system 100 is operated in the heating mode as shown in FIG. 1). The pressure sensors 111, 115 may be coupled to or included within outdoor unit 104. Further, heat pump system 100 may include a temperature sensor 113 configured to sense or detect a temperature of the coil 109 of the indoor heat exchanger 108 and a temperature sensor 119 configured to sensor or detect a temperature of the coil 117 of outdoor heat exchanger 114. In some embodiments, the temperature of the coils 109, 117 (e.g., the temperature measured by sensors 113, 119, respectively) may comprise the external temperature of the coils 109, 117, the temperature of the refrigerant flowing through the coils 109, 117, or a combination thereof. In some embodiments, the material forming coils 109, 117 may be thermally conductive, so that a temperature of the refrigerant flowing within coils 109, 117 may be the same, substantially the same, or relatively close to the temperature of the coils 109, 117 themselves. Each of the sensors 111, 113, 115, 119 may be coupled to system controller 106 (e.g., either directly or through one of the indoor controller 124 and outdoor controller 126) through a suitable communication path (which may be any suitable wired communication path, wireless communication path, or a combination thereof). In some embodiments, one or more of the sensors 111, 113, 115, 119 are omitted from the heat pump system 100.

The system controller 106 may also be in communication with an input/output (I/O) unit 107 (e.g., a graphical user interface, a touchscreen interface, or the like) for displaying information and for receiving user inputs. The I/O unit 107 may display information related to the operation of the heat pump system 100 (e.g., from system controller 106) and may receive user inputs related to operation of the heat pump system 100. During operations, I/O unit 107 may communicate received user inputs to the system controller 106, which may then execute control of HVAC system 100 accordingly. Communication between the I/O unit 107 and system controller 106 may be wired, wireless, or a combination thereof. In some embodiments, the I/O unit 107 may further be operable to display information and receive user inputs tangentially and/or unrelated to operation of the heat pump system 100. In some embodiments, however, the I/O unit 107 may not comprise a display and may derive all information from inputs from remote sensors and remote configuration tools (e.g., remote computers, servers, smartphones, tablets, etc.). In some embodiments, system controller 106 may receive user inputs from remote configuration tools, and may further communicate information relating to HVAC system 100 to I/O unit 107. In these embodiments, system controller 106 may or may not also receive user inputs via I/O unit 107.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the heat pump system 100 components configured for interfacing with the communication bus 128. Still further, the system controller 106 may be configured to selectively communicate with heat pump system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the heat pump system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

System controller 106, indoor controller 124, outdoor controller 126, compressor drive controller 144, indoor fan controller 142, and indoor EEV controller 138 may each comprise any suitable device or assembly which is capable of receiving electrical (or other data) signals and transmitting electrical (or other data) signals to other devices. In particular, while not specifically shown, controllers 106, 124, 126, 138, 142, and 144 may each include a processor and a memory. The processors (e.g., microprocessor, central processing unit, or collection of such processor devices, etc.) may execute machine readable instructions (e.g., non-transitory machine-readable instructions) provided on the corresponding memory to provide the processor with all of the functionality described herein. The memory of each controller 106, 124, 126, 138, 142, and 144 may comprise volatile storage (e.g., random access memory), non-volatile storage (e.g., flash storage, read only memory, etc.), or combinations of both volatile and non-volatile storage. Data consumed or produced by the machine readable instructions can also be stored on the memory of controllers 106, 124, 126, 138, 142, and 144.

During operations, system controller 106 may generally control the operation of heat pump system 100 through the indoor controller 124, outdoor controller 126, compressor drive controller 144, indoor fan controller 142, and indoor EEV controller 138 (e.g., via communication bus 128). In the description below, specific control methods are described (e.g., method 200). It should be understood that the features of these described methods may be performed (e.g., wholly or partially) by system controller 106, and/or by one or more of controllers 124, 126, 144, 142, 138 as directed by system controller 106. As a result, the controller or controllers of heat pump system 100 (e.g., controllers 106, 124, 126, 142, 144, 138, etc.) may include and execute machine-readable instructions (e.g., non-volatile machine readable instructions) for performing the operations and methods described in more detail below. In some embodiments, each of the controllers 106, 124, 126, 138, 142, and 144 may be embodied in a singular control unit, or may be dispersed throughout the individual controllers 106, 124, 126, 138, 142, and 144 as described above.

As shown in FIG. 1, the heat pump system 100 is configured for operating in a so-called heating mode in which heat may generally be absorbed by refrigerant at the outdoor heat exchanger 114 and rejected from the refrigerant at the indoor heat exchanger 108. Starting at the compressor 116, the compressor 116 may be operated to compress refrigerant and pump the relatively high temperature and high pressure compressed refrigerant through the reversing valve 122 and to the indoor heat exchanger 108. As the refrigerant flows through coil 109 of indoor heat exchanger 108, the refrigerant may transfer heat to an airflow that is passed through and/or into contact with the coil 109 by the indoor fan 110. After exiting the indoor heat exchanger 108, the refrigerant may flow through and/or bypass the indoor metering device 112, such that refrigerant flow is not substantially restricted by the indoor metering device 112. Refrigerant generally exits the indoor metering device 112 and flows to the outdoor metering device 120, which may meter the flow of refrigerant through the outdoor metering device 120, such that the refrigerant downstream of the outdoor metering device 120 is at a lower pressure than the refrigerant upstream of the outdoor metering device 120. From the outdoor metering device 120, the refrigerant may enter the outdoor heat exchanger 114. As the refrigerant is passed through coil 117 of outdoor heat exchanger 114, heat may be transferred to the refrigerant from an airflow that is passed through and/or into contact with the coil 117 of outdoor heat exchanger 114 by the outdoor fan 118. Refrigerant leaving the outdoor heat exchanger 114 may flow to the reversing valve 122, where the reversing valve 122 may be selectively configured to divert the refrigerant back to the compressor 116, where the refrigeration cycle may begin again.

While not specifically shown in FIG. 1, heat pump system 100 may be configured for operating in a so-called cooling mode. Most generally, the roles of the indoor heat exchanger 108 and the outdoor heat exchanger 114 are reversed as compared to their operation in the above-described cooling mode. For example, the reversing valve 122 may be controlled to alter the flow path of the refrigerant from the compressor 116 to the outdoor heat exchanger 114 first and then to the indoor heat exchanger 108, the indoor metering device 112 may be enabled, and the outdoor metering device 120 may be disabled and/or bypassed. In cooling mode, heat may generally be absorbed by refrigerant at the indoor heat exchanger 108 and rejected by the refrigerant at the outdoor heat exchanger 114. As the refrigerant is passed through the coil 109 of indoor heat exchanger 108, the indoor fan 110 may be operated to move air into contact with the coil 109, thereby transferring heat to the refrigerant from the air surrounding the indoor heat exchanger 108. Additionally, as refrigerant is passed through the coil 117 of outdoor heat exchanger 114, the outdoor fan 118 may be operated to move air into contact with coil 117, thereby transferring heat from the refrigerant to the air surrounding the outdoor heat exchanger 114.

Figure 2:
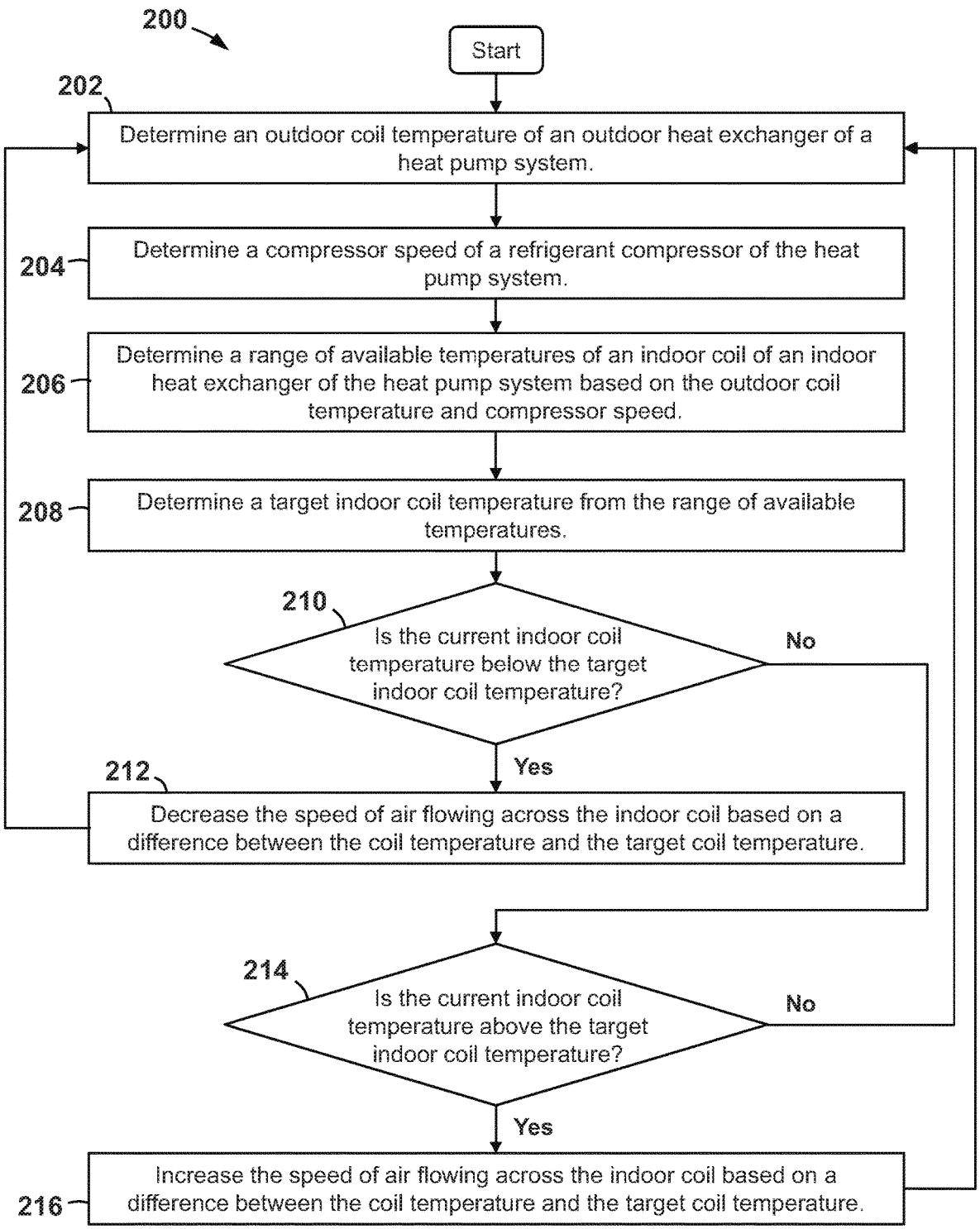
FIG. 2 is a flow chart of a method of controlling a superheat of refrigerant within a climate control system according to some embodiments.

Referring now to FIG. 2, a method 200 of controlling a temperature of air delivered to an indoor space from a heat pump system (e.g., heat pump system 100) is shown. In some embodiments, method 200 may be practiced with heat pump system 100 as previously described above. Thus, in describing the features of method 200, continuing reference will made to the heat pump system 100 shown in FIG. 1; however, it should be appreciated that embodiments of method 200 may be practiced with other systems, assemblies, and devices.

Initially, method 200 includes determining an outdoor coil temperature of an outdoor heat exchanger of a heat pump system at 202. The outdoor coil temperature may be directly or indirectly measured, detected, estimated, or inferred. Specifically, referring briefly again to FIG. 1, in some embodiments, the current temperature of the coil 117 in outdoor heat exchanger 114 may be measured at 202 with the temperature sensor 119 as previously described.

Alternatively, in some embodiments the current temperature of outdoor coil 117 may be indirectly measured or estimated from other measured values or parameters at 202. For instance, in some embodiments, a pressure of the refrigerant may be measured or detected at any suitable location within heat pump system 100 (e.g., within outdoor unit 104, indoor unit 102, etc.), and then the temperature of coil 109 may then be calculated or estimated based on known relationships and variables. Specifically, in some embodiments, pressure sensor 115 may measure a pressure of the refrigerant downstream of outdoor heat exchanger 114 and upstream of compressor 116 as previously described. This measured pressure may be converted (e.g., via a look up table or suitable calculation, etc.) into a saturated suction temperature (SST) of the refrigerant at the measured pressure. As used herein, "saturation suction temperature" or SST refers to the temperature at which the refrigerant boils/vaporizes within the evaporator coils (which corresponds with the outdoor coil 117 in the heating mode of FIG. 1) for a given pressure. Thus, a derived value for SST may not reflect the actual temperature of the refrigerant at the suction of the compressor 116, but instead reflects the approximate phase change temperature of the refrigerant (e.g., vaporization temperature) at the measured pressure (e.g., as measured by sensor 115). During operation of HVAC system 100 in the above described "heating mode," the refrigerant is to change phase from liquid to a vapor as it absorbs heat energy from the outdoor ambient air flowing across the coil 117. Thus, while the refrigerant is in the coil 117, it remains at (or substantially at) the vaporization temperature until all (or again substantially all) of the liquid refrigerant has vaporized. Thereafter, the refrigerant begins to increase in temperature above the vaporization temperature as additional heat energy is absorbed from the air flowing across the coil 109. This additional temperature increase is typically referred to as "superheat." Thus, after appropriate correction or offset for refrigerant pressure drop (e.g., between coil 117 and compressor 116), the SST value of the refrigerant may provide the temperature of the refrigerant while it was flowing through the coil 117 (or during a majority of the time the refrigerant was flowing through the coil 117).

Referring again to FIG. 2, method 200 also includes determining a compressor speed of a refrigerant compressor of the heat pump system at 204. As with the coil temperature at 202, the compressor speed may be determined at 204 via any suitable direct or indirect method. For instance, within the heat pump system 100 in FIG. 1 the speed of compressor 116 may be determined by querying compressor drive controller 144, by measuring a speed of the compressor 116 with an appropriate sensor (or sensors) (e.g., such as a sensor for measuring the revolutions per minute—RPM—of the compressor or compressor driver), estimating the speed of compressor 116 based on other values (e.g., the discharge pressure of compressor 116), or a combination thereof.

Once the outdoor coil temperature and compressor speed have been determined at 202 and 204, respectively, method 200 may proceed to determine a range of available indoor coil temperatures of the indoor heat exchanger of the heat pump system based on the outdoor coil temperature and the compressor speed at 206. Specifically, in some embodiments, the compressor speed and outdoor coil temperature may be mapped to the range of available indoor coil temperatures. In some embodiments, the range of indoor coil temperatures may be determined so as to maintain the compressor at its current operating speed (or within a desired speed range), which may be further determined by the current heating demand within the indoor space (e.g., based on a user selected indoor temperature). The mapping of the compressor speed and outdoor coil temperature to the range of indoor coil temperatures at 206 may be mathematically calculated, determined by a look-up table, chart or other pre-derived mapping tool, or some combination thereof.

Once a range of available indoor coil temperatures is determined at 206 as described above, method 200 includes determining a target indoor coil temperature from the range of available temperatures at 208. In some embodiments, the target coil indoor temperature may be selected to provide a desired temperature rise in the air flowing across the indoor coil. Specifically, in some embodiments the target indoor coil temperature may be determined or selected from the available range at 206 so as to increase a temperature of the air flow flowing across the coil of the indoor heat exchanger a predetermined amount. In some embodiments, the predetermined amount may equal approximately 30° F. In some embodiments, such an increase in air temperature may be accomplished by increasing the indoor coil temperature a predetermined amount above the desired temperature for air leaving the indoor heat exchanger and subsequently distributed within the indoor space (which may be referred to herein as "leaving air temperature"). For instance, in some embodiments, the predetermined amount or difference between the desired leaving air temperature and the coil temperature may be approximately 10° F., such that for embodiments targeting an approximately 30° F. temperature rise in the air flowing across the indoor coil, the target coil temperature may be approximately 40° F. above the temperature of the air flowing to and through the indoor heat exchanger (e.g., heat exchanger 108) during operations.

It should be appreciated that because the target coil temperature is ultimately selected at 208 from the range of indoor coil temperatures determined at 206, an upper limit on the target indoor coil temperature may be set so as to maintain the compressor at its current speed (or within a range of speeds as previously described). Thus, in some embodiments, a temperature rise of less than the predetermined amount (e.g., 30° F. in some embodiments as previously described) may be achieved via the selected target indoor coil temperature at 208. However, even in these embodiments, a target coil temperature may be selected at 208 from the range determined at 206 so as to provide a sufficiently high leaving air temperature to ensure occupant comfort as previously described above. For instance, in some specific embodiments, a leaving air temperature from indoor heat exchanger 108 may desirably be approximately 100° F. so as to avoid so called "cold blow." This desired leaving air temperature may be sufficient to avoid cold blow regardless of the ambient indoor or outdoor conditions. Thus, in some embodiments, the target indoor coil temperature determined at 208 may be selected to produce a leaving air temperature of 100° F., even if a higher value would be called for to produce a desired temperature rise for the air flowing across the coil 109 (which was previously described above as approximately equaling 30° F. for some embodiments). Since the difference between indoor coil temperature and leaving air temperature may be approximately 10° F. in some embodiments, the target indoor coil temperature may be set at 110° F. in these embodiments.

Setting the target coil temperature to a predetermined value within the range of available temperatures determined at 206 (e.g., a predetermined value to produce a leaving air temperature of approximately 100° F. in some embodiments) may be utilized in embodiments where the predetermined value is within the range of values determined at 206. In addition, by selecting the leaving air temperature as a predetermined value to avoid cold blow (e.g., 100° F.), even if overall conditions (e.g., ambient indoor and/or outdoor conditions) may call for a higher leaving air temperature, the speed of compressor 116 may be maintained within its current operating window, so as to maintain a relatively high level of system efficiency while providing a sufficiently warm leaving air temperature for occupant comfort. In some embodiments, the upper limit of the range of values for the target indoor coil temperature may be below the predetermined value described above. In these embodiments, the selected value for the target indoor coil temperature may be the upper limit of the range of values.

Referring again to FIG. 2, method 200 next includes determining whether the indoor coil temperature is below the target coil temperature at 210. Referring briefly again to FIG. 1, the current temperature of indoor coil 109 may be determined by directly measuring a temperature via sensor 113, or may be estimated by measuring a pressure of the refrigerant. For instance, in some embodiments, a pressure of the refrigerant may be measured by pressure sensor 111 and then converted to an associated condensing temperature. Specifically, the converted temperature at pressure sensor 111 may be referred to as a saturated temperature (ST) of the refrigerant. After appropriate offsets are applied (e.g., such as for pressure drop between coil 109 and pressure sensor 111), the ST may provide a close approximation or equivalent of the refrigerant condensing temperature while it was flowing within the indoor coil 109. Because the refrigerant may be maintained at its condensing temperature while flowing through (or at least most of) the coil 109, the condensing temperature may provide the temperature of coil 109 during operations.

Referring again to FIG. 2, if the indoor coil temperature is below the target coil temperature (i.e., the determination at 210 is "Yes"), then method 200 proceeds to decrease the speed of air flowing across the indoor coil based on a difference between the indoor coil temperature and the target indoor coil temperature at 212. For instance, in the heat pump system 100 of FIG. 1, the speed of the air flowing within the heat exchanger may be decreased by adjusting the speed of the indoor fan 110.

If, on the other hand, the indoor coil temperature is not less than the target indoor coil temperature (i.e., the determination at 210 is "No"), method 200 proceeds to determine whether the indoor coil temperature is above the target indoor coil temperature at 214. If the indoor coil temperature is above the target indoor coil temperature (i.e., the determination at 214 is "Yes"), method 200 proceeds to increase the speed of air flowing across the indoor coil based on a difference between the indoor coil temperature and the target indoor coil temperature at 216. Referring briefly again to the heat pump system 100 of FIG. 1, the speed of the air flowing within the indoor heat exchanger 108 may be increased by again adjusting the speed of indoor fan 110.

If, on the other hand, it is determined that the indoor coil temperature is not above the current coil temperature (i.e., the determination at 214 is "No"), then method 200 returns to 202 to re-start method 200. Accordingly, if the indoor coil temperature is equal to (or approximately equal to) the target indoor coil temperature, the determinations at blocks 210 and 214 will be "No" and adjustments (e.g., increases and decreases) in the speed of air flowing across the coil of the indoor heat exchanger may be prevented. Thus, in this event, the return to block 202, may re-start method 200. Alternatively, in some embodiments, if the indoor coil temperature is equal (or approximately equal to) to the target indoor coil temperature (e.g., such that the determinations at blocks 210, 214 is "No" as previously described), method 200 may end and the current values or modifications of indoor air speed may be maintained until the end of the current heating cycle (that is, until the heat pump is cycle is shut due to e.g., achievement of the desired indoor temperature).

At blocks 212, 216 of method 200, various logic, calculations, or control operations may be used to determine a magnitude of the air speed increases or decreases across the indoor coil (e.g., coil 109). For instance, in some embodiments, the changes to the speed of the air at 212, 216 may be based on (e.g., proportional to) the difference between the indoor coil temperature and the target indoor coil temperature.

In addition, in some embodiments, method 200 may employ a proportional and integral (PI) control loop, function, or scheme at 212, 216 to provide the desired speed changes for the indoor air speed (e.g., via changes to the speed of indoor fan 110). Specifically, in some embodiments the difference between the indoor coil temperature and target indoor coil temperature (e.g., found in blocks 212, 216) is used as a feedback error within a PI control loop for controlling the indoor fan speed at blocks 212, 216. During this process, proportional and integral gain values for the indoor fan speed may be utilized in addition the feedback error to compute the desired speeds of the indoor fan at blocks 212, 216. These gain values may be derived experimentally or empirically and may be specific to a type, size, model, etc. of the indoor fan 100 and compressor 116. In some embodiments, a target range (e.g., a target speed range) may be computed for the indoor fan 110 at blocks 212, 216 as a part of the PI control loop described above, so as to adjust the indoor fan 110 to a desired ranged of values (rather than a singular value) to affect the desired changes to the temperature of coil 109.

In some embodiments, the determinations at both 210 and 214 may comprise determining whether the indoor coil temperature is below and above, respectively, the target indoor coil temperature as previously described. Alternatively, in some embodiments, one or both of the determinations at 210 and 214 may comprise determining whether the indoor coil temperature is within some predetermined range of the target indoor coil temperature. Specifically, in some embodiments, the determination at 210 may comprise determining whether the indoor coil temperature is a predetermined amount below the target indoor coil temperature and the determination at 214 may comprise determining whether the indoor coil temperature is a predetermined amount above the target indoor coil temperature. Thus, in these embodiments, if the indoor coil temperature is determined at 210, 214 to be within a predetermined range about the target indoor coil temperature, adjustments (e.g., increases and decreases) of the speed of air flowing over the coil of indoor heat exchanger at 212 and 216, respectively, may be prevented and method 200 may restart at 202 or end as previously described above.

In addition, as shown in FIG. 2, following the decrease and increase in the speed of air flowing across the indoor coil at 212 and 216, respectively, in some embodiments method 200 returns back to 202 to re-initiate the operations described above. Thus, in these embodiments a cyclical operation of method 200 (that is returning back to block 202 following the operations at 211, 216 as well as after a "No" determination at block 214 as previously described), method 200 may continuously control the indoor coil temperature of a heat pump system so as to maintain a desired leaving air temperature that is optimized to provide both comfort for occupants of the indoor space and to maintain the speed of the compressor within a desired operational window.

As previously described, in some embodiments the condensing temperature of the refrigerant (or a value that is related thereto) may be used as a proxy for the actual indoor coil temperature during some or all blocks of method 200. Specifically, in some embodiments, the ST value obtained for the refrigerant (e.g., via pressure sensor 111 as previously described) may be controlled in order to control an indoor coil temperature. Because ST provides a close approximation of the condensing temperature of the refrigerant while flowing through coil 109, it may provide a suitable stand-in during the above described control operations of method 200. Thus, the above described operations (e.g., blocks) of method 200 may be altered in some embodiments to control operation of the heat pump system based on a target ST in place of a target indoor coil temperature. However, because ST is simply a stand-in (or proxy) for the actual indoor coil temperature, operation of blocks 210, 212, 214, 216 in this manner would still be considered to be adjustments of the speed of air across the indoor heat exchanger based on a difference between an "indoor coil temperature" and a "target indoor coil temperature" as previously described.

Thus, through use of the systems and methods described herein (e.g., heat pump system 100, method 200, etc.), a leaving air temperature of a heat pump system may be actively controlled during operations so as to avoid occupant discomfort, and to ensure that a compressor of the heat pump system (e.g., compressor 116) is operated within a desired envelope. Specifically, embodiments disclosed herein control an indoor coil temperature with a speed of air flowing across the coil (e.g., coil 109) so as to achieve and maintain a desired leaving air temperature, and thereby ensure that occupants within the indoor space do not experience cold blow as previously described above. Therefore, while embodiments disclosed herein may include additional sensors (e.g., sensors 111, 113, 115, 119) which may provide additional complexity and increased possibility for failures, the system and methods disclosed herein may provide enhanced performance as described above.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of controlling indoor air temperature of a heat pump system, the method comprising:

(a) determining, during a heating mode, an outdoor coil temperature of an outdoor heat exchanger and a speed of a compressor of a heat pump system;

(b) determining, during the heating mode, a target indoor coil temperature of the indoor coil based on the outdoor coil temperature and the speed of the compressor; and (c) adjusting, during the heating mode, a speed of air flowing across the indoor coil based on a difference between a current indoor coil temperature and the target indoor coil temperature to reduce the difference between the current indoor coil temperature and the target indoor coil temperature.

2. The method of claim 1, wherein (b) comprises:

(b1) determining a range of values for the indoor coil temperature based on the outdoor coil temperature and the speed of the compressor; and (b2) selecting the target indoor coil temperature from the range of values.

3. The method of claim 2, wherein (b2) comprises selecting a predetermined value within the range of values.

4. The method of claim 3, wherein the predetermined value comprises approximately 110° F.

5. The method of claim 1, wherein (c) comprises:

(c1) decreasing the speed of air flowing across the indoor coil if the current indoor coil temperature is below the target indoor coil temperature; or (c2) increasing the speed of air flowing across the indoor coil if the current indoor coil temperature is above the target indoor coil temperature.

6. The method of claim 1, comprising determining the current indoor coil temperature before (c).

7. The method of claim 6, wherein determining the current indoor coil temperature comprises measuring a temperature of the refrigerant.

8. The method of claim 6, wherein determining the current indoor coil temperature comprises measuring a pressure of the refrigerant downstream of the indoor coil and upstream of the outdoor heat exchanger.

9. A heat pump system, comprising:

an indoor heat exchanger comprising an indoor coil to flow refrigerant therethrough;

an outdoor heat exchanger comprising an outdoor coil to flow refrigerant therethrough;

a first sensor configured to detect a value indicative of a temperature of the outdoor coil;

an indoor fan configured to flow air over the indoor coil;

a compressor configured to compress the refrigerant that is to be flowed through the indoor coil and the outdoor coil; and a controller to be coupled to the first sensor, the indoor fan, and the compressor, wherein the controller is configured to:

determine, during a heating mode, a temperature of the outdoor coil via the first sensor and a speed of the compressor;

determine, during the heating mode, a target indoor coil temperature based on the temperature of outdoor coil and the speed of the compressor; and adjust, during the heating mode, a speed of air flowing across the indoor coil based on a difference between the indoor coil temperature and the target indoor coil temperature.

10. The heat pump system of claim 9, wherein the controller is configured to determine a range of values for the indoor coil temperature based on the outdoor coil temperature and the speed of the compressor; and select the target indoor coil temperature from the range of values.

11. The heat pump system of claim 10, wherein the controller is configured to select a predetermined value within the range of values.

12. The heat pump system of claim 9, wherein the controller is configured to:

decrease the speed of air flowing across the indoor coil if the coil temperature is below the target coil temperature; and increase the speed of air flowing across the indoor coil if the coil temperature is above the target coil temperature.

13. The heat pump system of claim 9, wherein the controller is configured to determine the current indoor coil temperature via a first sensor.

14. The heat pump system of claim 13, wherein determining the current indoor coil temperature comprises measuring a temperature of the refrigerant with the first sensor.

15. The heat pump system of claim 13, wherein determining the current indoor coil temperature comprises measuring a pressure of the refrigerant downstream of the indoor coil and upstream of the outdoor heat exchanger.

16. A non-transitory machine-readable medium including instructions that, when executed by a processor, cause the processor to:

(a) determine, during a heating mode, an outdoor coil temperature of an outdoor heat exchanger and a speed of a compressor of a heat pump system;

(b) determine, during the heating mode, a target indoor coil temperature of the indoor coil of an indoor heat exchanger of the heat pump system based on the outdoor coil temperature and the speed of the compressor; and (c) adjust, during the heating mode, a speed of air flowing across the indoor coil based on a difference between a current indoor coil temperature and the target indoor coil temperature.

17. The non-transitory machine-readable medium of claim 16, wherein the instructions, when executed by the processor, cause the processor to:

determine a range of values for the indoor coil temperature based on the outdoor coil temperature and the speed of the compressor; and select the target indoor coil temperature from the range of values.

18. The non-transitory machine-readable medium of claim 16, wherein the instructions, when executed by the processor, cause the processor to select a predetermined value within the range of values.

19. The non-transitory machine-readable medium of claim 16, wherein the instructions, when executed by the processor, cause the processor to:

decrease the speed of air flowing across the indoor coil if the indoor coil temperature is below the target indoor coil temperature; and increase the speed of air flowing across the indoor coil if the indoor coil temperature is above the target indoor coil temperature.

20. The non-transitory machine-readable medium of claim 16, wherein the instructions, when executed by the processor, cause the processor to detect a pressure of a refrigerant of the heat pump system and determine the indoor coil temperature based on the pressure.

21. The method of claim 1, further comprising (d) determining, during the heating mode, a second target indoor coil temperature after (c).

22. The heat pump system of claim 9, wherein the controller is further configured to determine, during the heating mode, a second target indoor coil temperature after adjusting, during the heating mode, the speed of air.

23. The non-transitory machine-readable medium of claim 16, wherein the instructions, when executed by the processor, cause the processor to (d) determining, during the heating mode, a second target indoor coil temperature after (c).

* * * * *